United States Patent [19]

Koizumi et al.

[11] Patent Number: 5,017,948

[45] Date of Patent: May 21, 1991

[54] INK JET RECORDING DEVICE WITH THERMAL ENERGY ADJUSTMENT

[75] Inventors: Ryoichi Koizumi, Hiratsuka; Hideaki Kishida, Yamato; Akira Katayama, Yokohama, all of Japan

[73] Assignee: Canon Kabushiki Kaisha, Tokyo, Japan

[21] Appl. No.: 512,600

[22] Filed: Apr. 24, 1990

Related U.S. Application Data

[63] Continuation of Ser. No. 410,010, Sep. 20, 1989, abandoned, which is a continuation of Ser. No. 276,034, Nov. 25, 1988, abandoned.

[30] Foreign Application Priority Data

Nov. 27, 1987 [JP] Japan ..... 62-297794
Nov. 27, 1987 [JP] Japan ..... 62-297795

[51] Int. Cl.[5] ..... B41J 2/05
[52] U.S. Cl. ..... 346/140 R
[58] Field of Search ..... 346/140 R, 76 PH

[56] References Cited

U.S. PATENT DOCUMENTS

| | | | |
|---|---|---|---|
| 4,095,232 | 6/1978 | Cha . | |
| 4,241,406 | 12/1980 | Kennedy et al. . | |
| 4,277,790 | 7/1981 | Heibein et al. . | |
| 4,303,927 | 12/1981 | Tsao . | |
| 4,345,262 | 8/1982 | Shirato et al. | 346/140 PD |
| 4,463,359 | 7/1984 | Ayata et al. | 346/1.1 |
| 4,510,505 | 4/1985 | Fukui | 346/76 PH |
| 4,520,373 | 5/1985 | Ayata et al. | 346/140 R |
| 4,544,931 | 10/1985 | Watanabe et al. | 346/140 R |
| 4,558,332 | 12/1985 | Takahashi | 346/140 R |
| 4,563,689 | 1/1986 | Murakami et al. | 346/1.1 |
| 4,684,957 | 8/1987 | Miura et al. . | |
| 4,866,462 | 9/1989 | Watanabe | 346/140 R |

*Primary Examiner*—George H. Miller, Jr.
*Attorney, Agent, or Firm*—Fitzpatrick, Cella, Harper & Scinto

[57] ABSTRACT

The present invention relates to an ink jet recording device comprising plural energy generating means for generating energy used for discharging an ink, detecting means for detecting the number of said energy generating means actuated at the same time, adjusting means for adjusting a voltage value of the actuating pulse applied, corresponding to a result detected by said detecting means, to said energy generating means.

29 Claims, 8 Drawing Sheets

INK JET RECORDING DEVICE WITH THERMAL ENERGY ADJUSTMENT

This application is a continuation of application Ser. No. 410,010 filed Sept. 20, 1989 which is the continuation of application Ser. No. 276,034 filed Nov. 25, 1988, both now abandoned.

BACKGROUND OF THE INVENTION

1. Field of the Invention

The present invention relates to an ink jet recording device, in particular to an ink jet recording device in which a heating element having a heat generator and an electrode connected thereto are provided in a liquid path as discharge energy generating means, and plural discharging openings communicated to the liquid path are provided.

2. Related Background Art

Because of low noise upon recording, ease of recording using coloring, and the capability of recording on a normal sheet, ink jet recoding has been recently accorded great notice.

One ink jet recording method, in which power is supplied to the heating elements provided in fine path communicated to the discharging opening for discharging the ink utilizing sudden volume change upon foaming generated by heating of the ink around the heating element, in other words, the ink jet recording device utilizing thermal energy, has been accorded notice because the device can be made compact with discharging openings arranged in high density.

In such an ink jet recording device utilizing thermal energy, in the case where the recording head is constructed by arranging plural orifices in an integrated state in a predetermined direction, for example, in the case of so-called full-line type recording head in which discharging openings are arranged over the full width of a recording medium, voltage is supplied to all heating elements or to groups of a predetermined number of the heating elements to actuate them.

However, there has inevitably existed wiring resistance because of wiring lines between the recording head and the power source and actuating energy for the heating elements is subject to variation resulting from the different number of dots to be recorded in one time. In detail, when the number of dots is small, electric current flowing in the line is small and voltage decrease is small, but the electric current is large when the number of the dots is large, and accordingly the voltage decrease is large.

Difference of voltage biased to the heating element, due to the number of the heating elements associated with actuation, leads to variation of discharging energy acting on the ink, so that recording quality may vary corresponding to the number of dots to be recorded at one time.

SUMMARY OF THE INVENTION

It is an object of the present invention to provide an ink jet recording device in which stabilized actuating energy is supplied to the heating element regardless of the numbers of dots to be recorded at one time to impart stabilized discharging energy to the ink, thereby improving the recording quality of the ink jet recording device.

It is another object of the present invention to provide an ink jet recording device comprising plural energy generating means for generating energy used for discharging ink; detecting means for detecting the number of energy generating means actuated at the same time; adjusting means for adjusting a voltage value of the actuating pulse applied, corresponding to the number detected by said detecting means, to said energy generating means.

It is still another object of the present invention to provide an ink jet recording device comprising, plural energy generating means for generating energy used for discharging ink; detecting means for detecting the number of energy generating means actuated at the same time; adjusting means for adjusting an actuating time of an actuating pulse applied to the energy generating means corresponding to the number detected by the detecting means.

DESCRIPTION OF THE PREFERRED EMBODIMENT

The present invention is featured by adjusting the voltage value or actuating time of the actuating pulse, corresponding to the number of energy generating means actuated at the same time, to maintain the ink discharging property stable.

In a preferred embodiment of the present invention, voltage adjusting means, corresponding to the number of discharging energy generating means, supplies high voltage when said number is large, and supplies low voltage when said number is small, for example.

In another preferred embodiment of the present invention, actuation time adjusting means actuates discharge energy generating means for a long actuating time when said number is large, and short actuating time when said number is small.

By constructions as above, stabilized actuating energy can be supplied to discharge energy generating means to cancel influence from variation of the voltage decrease due to the wire resistance corresponding to said number.

Various embodiments according to the present invention will be explained hereinafter with reference to drawings. However, it is noted that the present invention should not be limited to the embodiments disclosed, but various modifications can be made within the scope of the present invention.

First Embodiment

Figure 1:
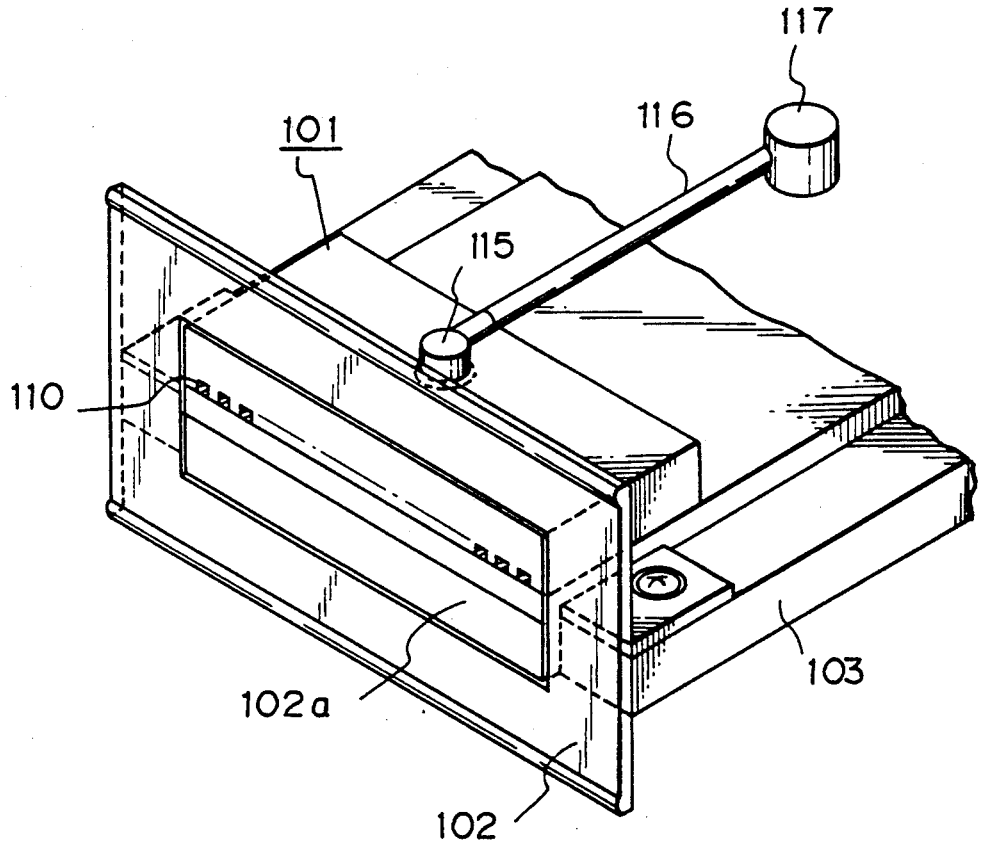
FIG. 1 is a typical perspective view of one embodiment of the recording head used in the ink jet recording device according to the present invention.

FIG. 1 is a typical perspective view showing one example of a recording head used in an ink jet recording device of the present invention In FIG. 1, reference numeral 101 designates a discharging element having a liquid path in which heat generating elements for generating heat energy used for ink discharging or the like are arranged as heat generating means in parallel in an integrated state, and a common chamber for storing the ink supplied to each liquid path and each of discharging openings 110 formed open to a front portion of each liquid path, thereby discharging the ink from the discharging openings 110 to form recording droplets.

Reference numeral 103 designates a base plate for fixing a discharging element 101 with an adhesive etc., which plate 103 has an opening 102*a* causing the discharging openings 110 to oppose directly to the recording medium. Reference numerals 115, 116 or 117 respectively designate a portion of an ink supplying system, in which numeral 115 shows a connecting 10 member of elbow configuration for introducing the ink into a common chamber in the discharging element, numeral 117 shows a filter unit disposed on the ink supplying path from the ink tank which is as ink supplying source, and numeral 116 shows a supplying tube connecting the connecting member 115 and the filter unit 117.

Figure 2:
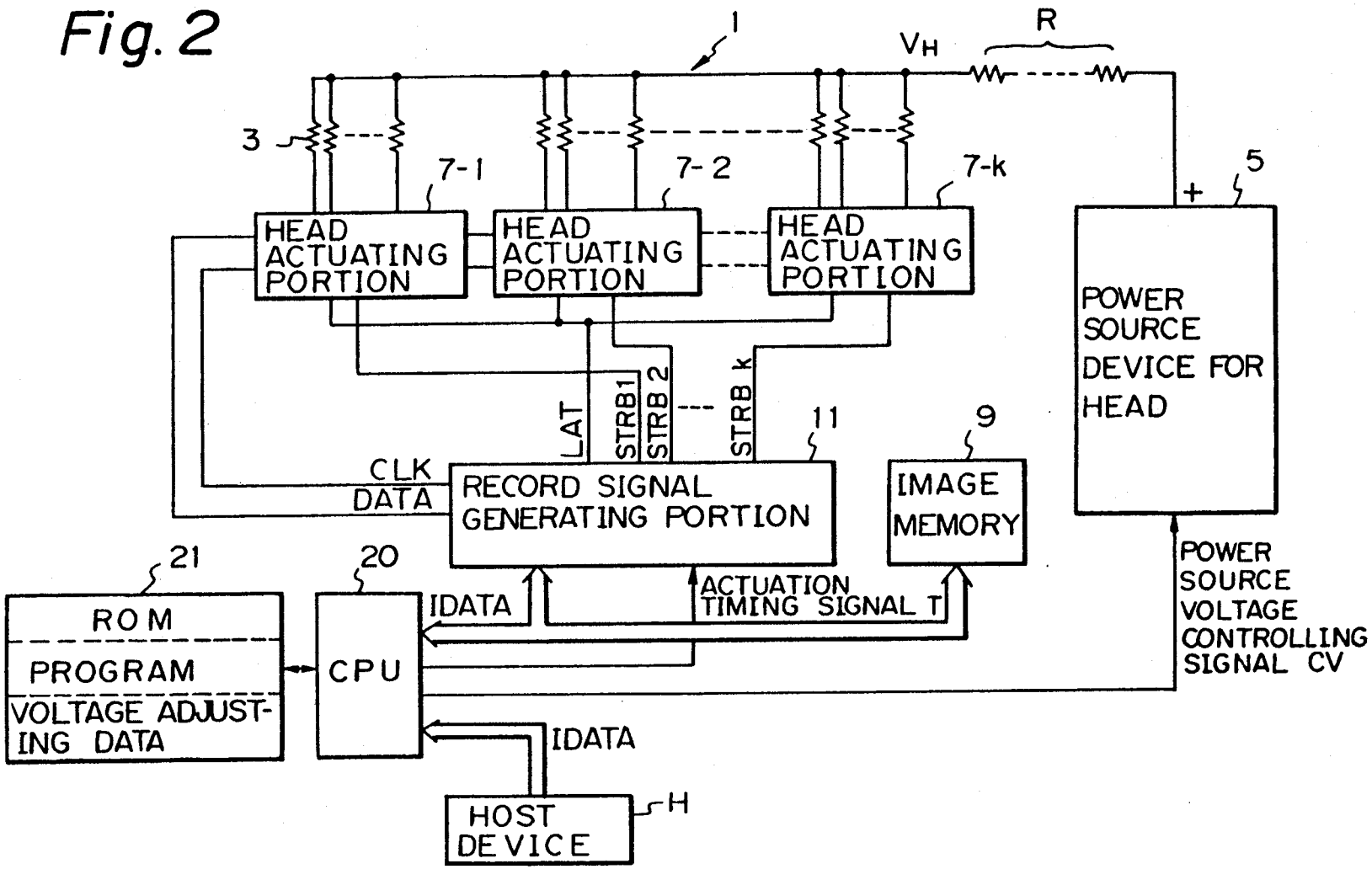
FIG. 2 is a flow chart showing one embodiment of the ink jet recording device according to the present invention.

FIG. 2 is a flow chart showing one embodiment of the ink jet recording device according to the present invention, in which reference numeral 1 designates a recording head in which plural orifices are arranged in an integrated state in a predetermined direction, as shown in FIG. 1, for example, in a width direction of a recording medium. Reference numeral 3 designates heating elements each provided corresponding to each liquid path. Reference numeral 5 designates a power source device for applying voltage to the heating elements 3 in the recording head 1, the construction of which will be explained with reference to FIG. 3. Reference R designates line resisting value, and VH designates voltage value biased to the recording head 1.

Reference numerals 7-1, 7-2 . . . . 7-k designate head actuating portions each provided to each of grouped heating elements 3, and each of the actuating portions includes a shift resistor for arranging a data signal DATA of 1-line with making correspondence by 1-bit to each of the heating elements 3, a latch circuit for latching a bit data corresponding to the latch signal LAT, and a switch effecting on-off operation of the power supply, corresponding to strobe signals STRB1–STRBk, based on the bit data. Reference numeral 9 designates an image memory for storing an image data IDATA supplied directly or via a CPU 20 from a host device H which is as an image data supplying source. Reference numeral 11 designates a record signal generating portion which reads out, corresponding to a timing signal T from the CPU 20, the image data developed in the image memory 9 and generating the data signal DATA, the clock signal CLK and the latch signal LAT, etc., further generating the strobe signals STRBI–STRBk for actuating the head actuating portions 7-1–7-k successively.

CPU 20, having, for example, microcomputer construction, controls each portion according to processing sequence which will be explained later in detail with reference to FIG. 4. ROM 21 stores a program corresponding to the processing sequence carried out by CPU 20, and a voltage adjusting data for adjusting the power source device 5 for the head. CV is a voltage controlling signal of the power source, for example, of 2-bit binary, generated at CPU 20 for causing the power source device 5 to adjust the voltage.

Figure 3:
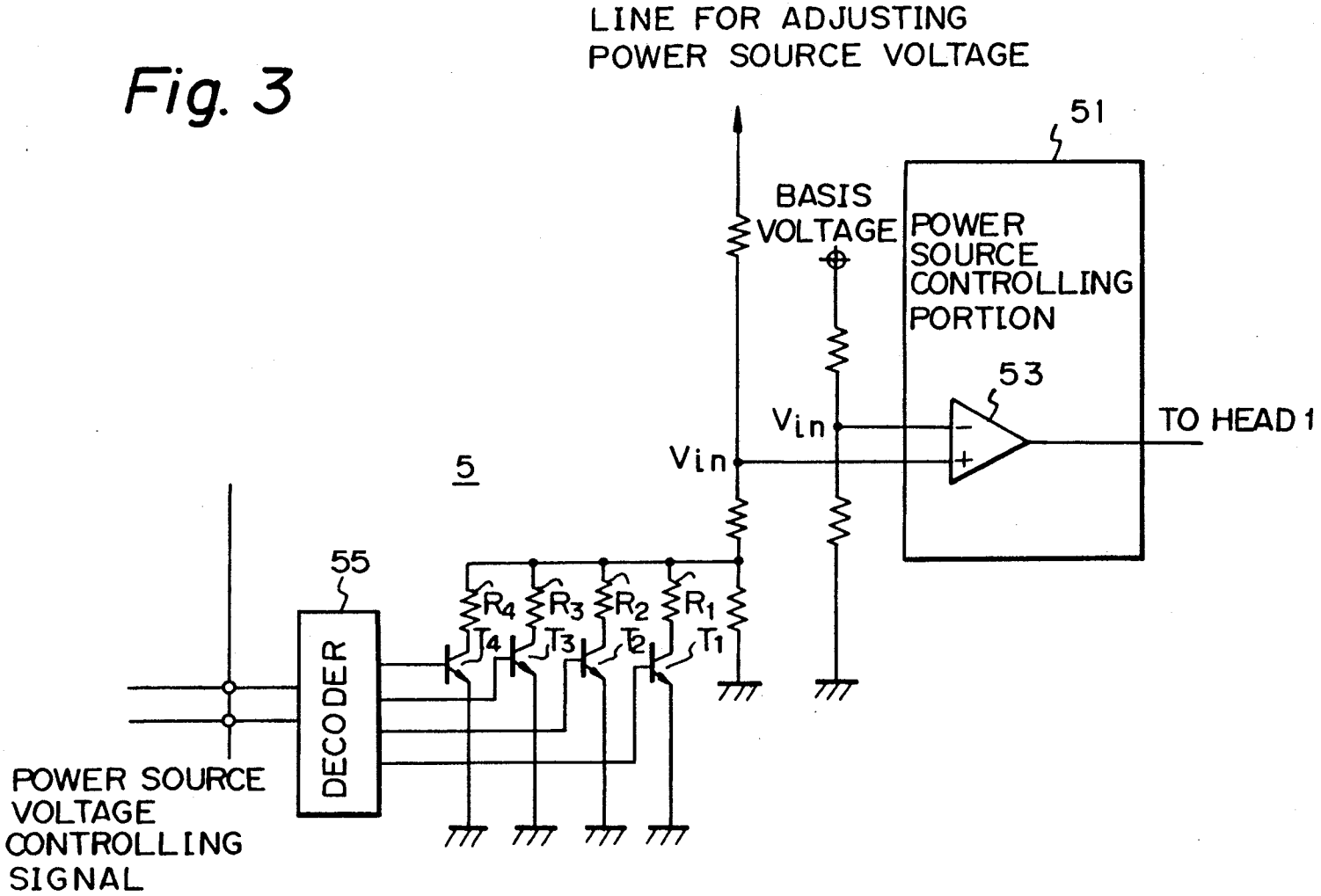
FIG. 3 is a block diagram showing one example of a power source device for the head in FIG. 2.

FIG. 3 is a flow chart showing one example of the power source device 5 for the head, in which reference numeral 51 designates a power source controlling portion. The controlling portion 51 has a calculating amplifier 53 which receives a basic voltage signal at minus terminal and a voltage signal from a voltage adjusting line for the power source at plus terminal thereby applying voltage of predetermined value to the recording head 1. Plural resistors R1–R4 of different resisting value (for example, R1>R2>R3>R4) are provided on the power source voltage adjusting line in parallel, and transistors T1–T4 for switching are provided in series to each resistor R1–R4, so that the resistors R1–R4 are made to be changeable.

A decoder 55 generates a switching signal for conducting any of the transistors T1–T4 corresponding to the power source voltage controlling signal CV of 2-bit binary which is supplied from CPU 20.

In such construction, CPU 20 adjusts voltage judging the data content developed in the memory 9. In detail, CPU 20 calculates the on-data number (the number of actuating bits) included in every data of predetermined amount (for example, in every total amount of data within the predetermined time period, in every one block associated with actuation by any of the head actuating portion 7-1–7-k, or in every data corresponding to 1-line), or calculates an average thereof; accesses the voltage adjusting data of ROM 21 based on the result thus calculated; and determines the controlling signal CV of power source voltage to supply it to the power source device 5 for the head.

In this way, the controlling signal sent out from CPU 20 in 2-bit binary enters into the decoder 55, and any of transistors T1–T4 is selected to be ON corresponding to value thereof. If the resistors R1–R4 are switched corresponding to the above, a voltage Vin of power source voltage adjusting line will vary and the power source voltage will vary corresponding to the actuating bit number. As a result, it becomes possible to send the stabilized voltage VH to the recording head 1 regardless of the number of actuating bits. For example, when the number of actuating bits is large, because voltage decrease due to wiring resistance is remarkable, the resistor R4 having smallest resisting value is to be selected. As the number of actuating bits become smaller, it is possible to have the selection made in the order of R3 to R2, R2 to R1.

Figure 4:
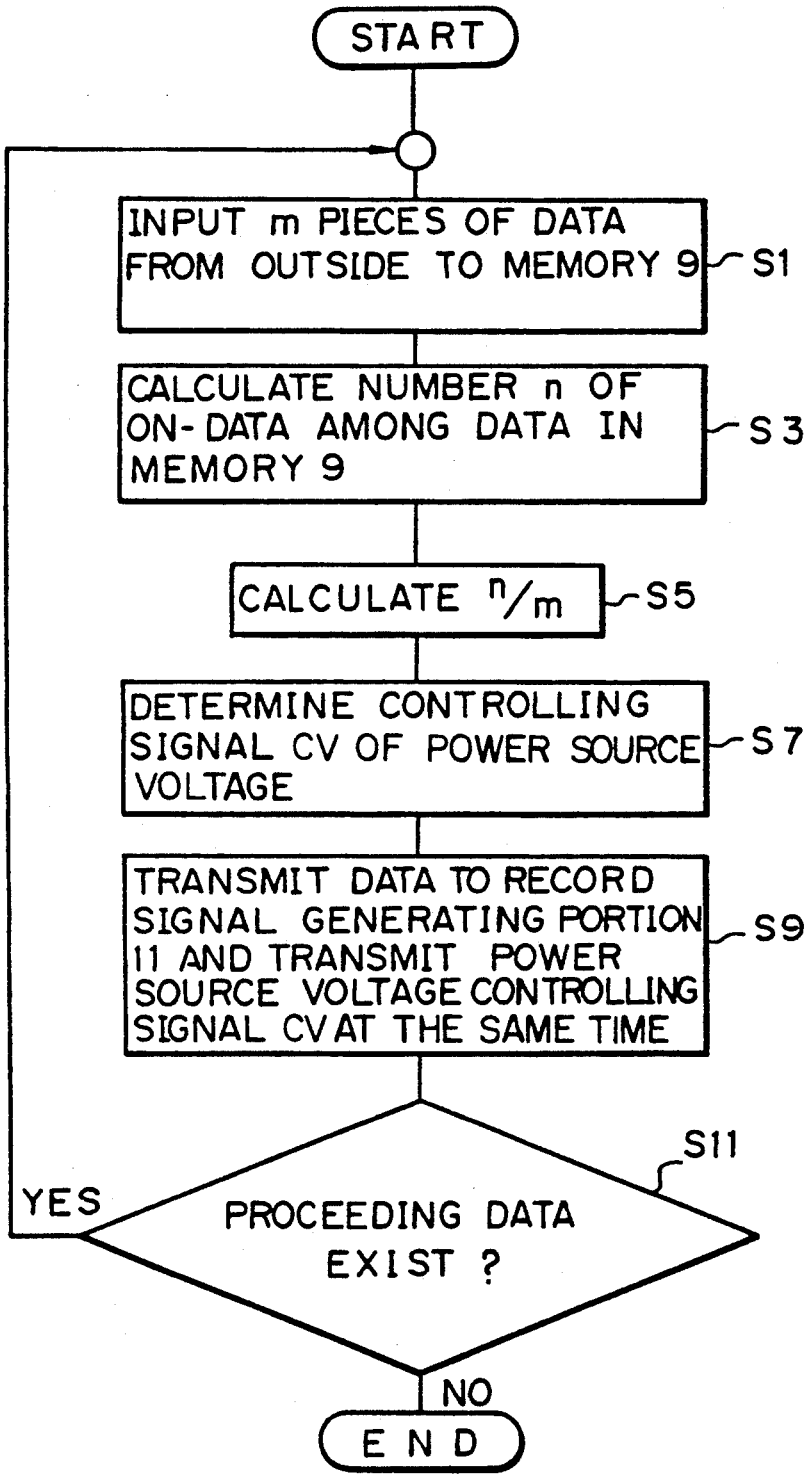
FIG. 4 is a flow chart showing a processing sequence of voltage adjustment in the embodiment of FIG. 2.

FIG. 4 is a flow chart showing one embodiment of voltage adjustment processing sequence by CPU 20. In the first, when predetermined amount m (for example, amount of 1-line) of image data is inputted into the memory 9 from the host device H outside in the step S1, the number of on data of the heat generating elements 3 there among, i.e. the number of actuating bits n is calculated in the step S3. Then, value of n/m is calculated in the step S5, and 2-bit binary value of the power source voltage controlling signal CV is determined with reference to the data area of ROM 21, corresponding to the value calculated.

In the step S9, CPU 20 send out the image data to the record signal generating portion 11 from the memory 9, and supplies controlling signal CV to the power source device 5. If the recording is carried out in this state by actuation of the heat generating element 3, because the stabilized voltage VH is applied to the heat generating element 3 regardless of the number of actuating bits, discharging energy to be acted to the ink will be stabilized.

Then, in the step S11, existence of the image data to be recorded next is judged, and in the case there exists such data process returns to the step S1, while if there exists no such data, the process will be finished.

In this way, according to the present embodiment, it is possible to provide the stabilized discharging energy to the ink regardless of the number of actuating bits. This enables carrying out stabilized ink discharging which leads to image recording of stabilized and of high quality. Because the data is calculated with respect o the image data developed in the image memory 9 to be switched, delay for voltage compensation relative to the number of actuating bits will not occur compared with the case in which the voltage compensating circuit is added to the power source device itself.

If the construction is made so that the number of actuating bits is calculated in a translating process of the image data IDATA to the memory 9 by a counter or the like, processing time of the above steps S1 and S3 can be shortened.

In the above embodiment, the transistors T1–T4 as well as the resistors R1–R4 are provided to adjust the voltage in four stages by the controlling signal CP of 2-bit binary, but it is needless to say that the number of the stages and switches are freely selected.

Additionally, in the above embodiment only the supply voltage of the power source is adjusted to make the supply voltage to the element constant, but in addition thereto, it is possible to adjust further the actuating time (on time) to the heat generating element 3 to make the actuating energy constant.

Second Embodiment

Figure 5:
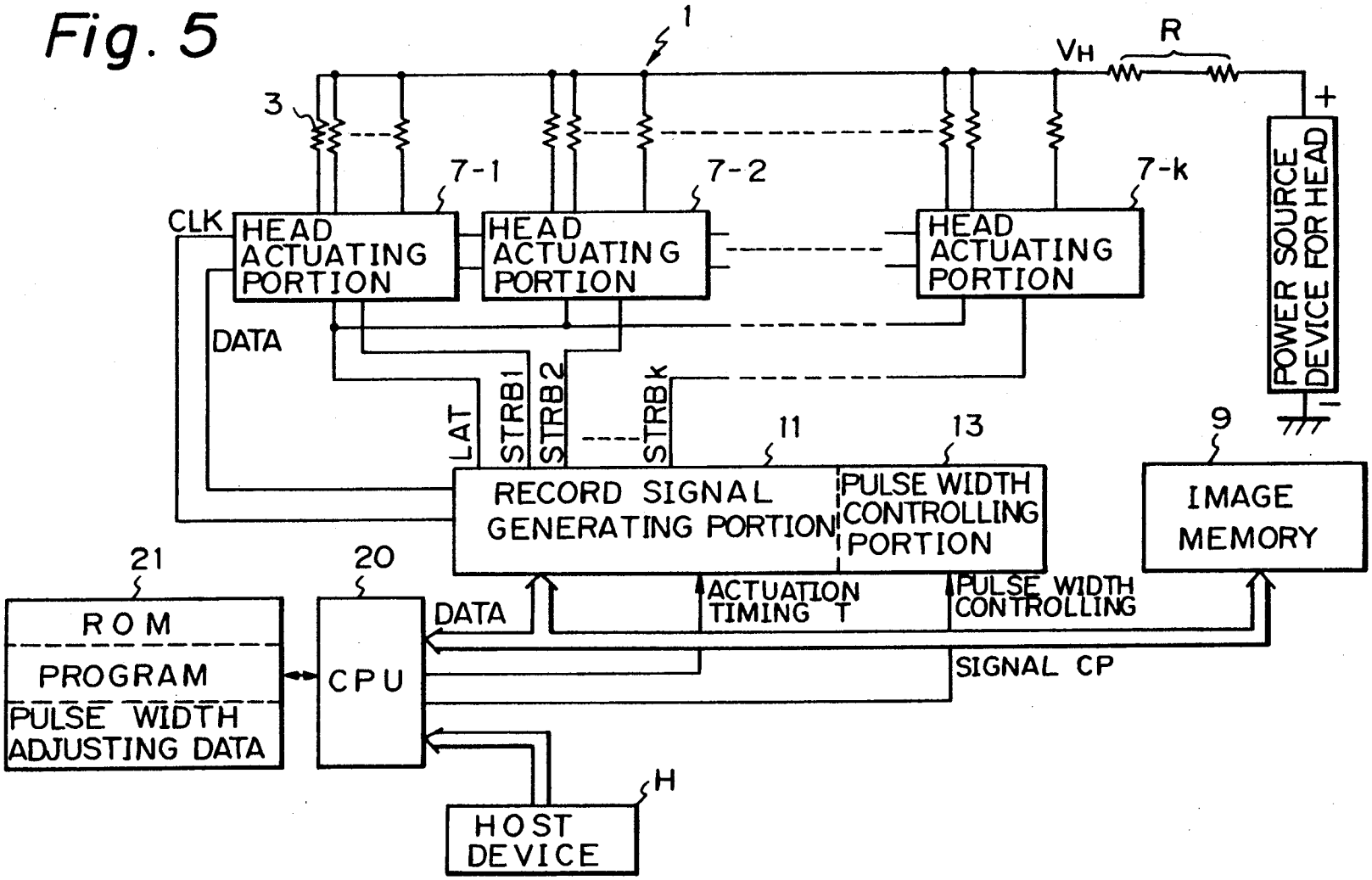
FIG. 5 is a block diagram showing another embodiment of the ink jet recording device according to the present invention.

FIG. 5 is a flow chart showing another embodiment of the ink jet recording device according to the present invention, in which reference numeral 1 designates a recording head in which plural orifices are arranged in an integrated state in a predetermined direction, for example, in a width direction of a recording medium over full width. Reference numeral 3 designates a heating element provided to each liquid path. Reference numeral 5 designates power source device for applying voltage to the heating element 3 in the recording head 1. Reference R designates a line resisting value, and VH designates voltage value biased to the recording head 1.

Reference numerals 7-1, 7-2 . . . 7-k designate head activating potions each provided to each of grouped heating elements 3, and each of the actuating portions includes a shift resistor for arranging a data signal DATA of 1-line with correspondence by 1-bit to each of the heating elements 3, a latch circuit for latching a bit data corresponding to the latch signal. LAT, and a switch effecting on-off operation of the power supply, corresponding to strobe signals STRB1–STRBk, based on the bit data. Reference numeral 9 designates an image memory for storing an image data IDATA supplied directly or via a CPU 20 from a host device H which is an image data supplying source. Reference numeral 11 designates a record signal generating portion which reads out, corresponding to a timing signal T from the CPU 20, the image data developed in the image memory 9 and generating the data signal DATA, the clock signal CLK and the latch signal LAT, etc., further generating the strobe signals STRB1–STRBk for actuating the head activating portions 7-1–7-k successively.

Reference numeral 13 designates a pulse width controlling portion integrally provided to the record signal generating portion 11, which controlling portion 13, by controlling of CPU 20, adjusts the strobe signals STRB1–STRBk regulating the actuation or on-time of the heat generating elements 3. This construction will be explained later with reference to FIG. 6.

CPU 20, having, for example, microcomputer construction, controls each portion according to processing sequence which will be explained later in detail with reference to FIG. 8. ROM 21 stores a program corresponding to the processing sequence carried out by CPU 20, and a voltage adjusting data for adjusting the power source device 5 for the head. CP is a pulse width controlling signal of, for example, 2-bit binary, generated by CPU 20 for causing the pulse width controlling portion to carry out the pulse width adjustment.

Figure 6:
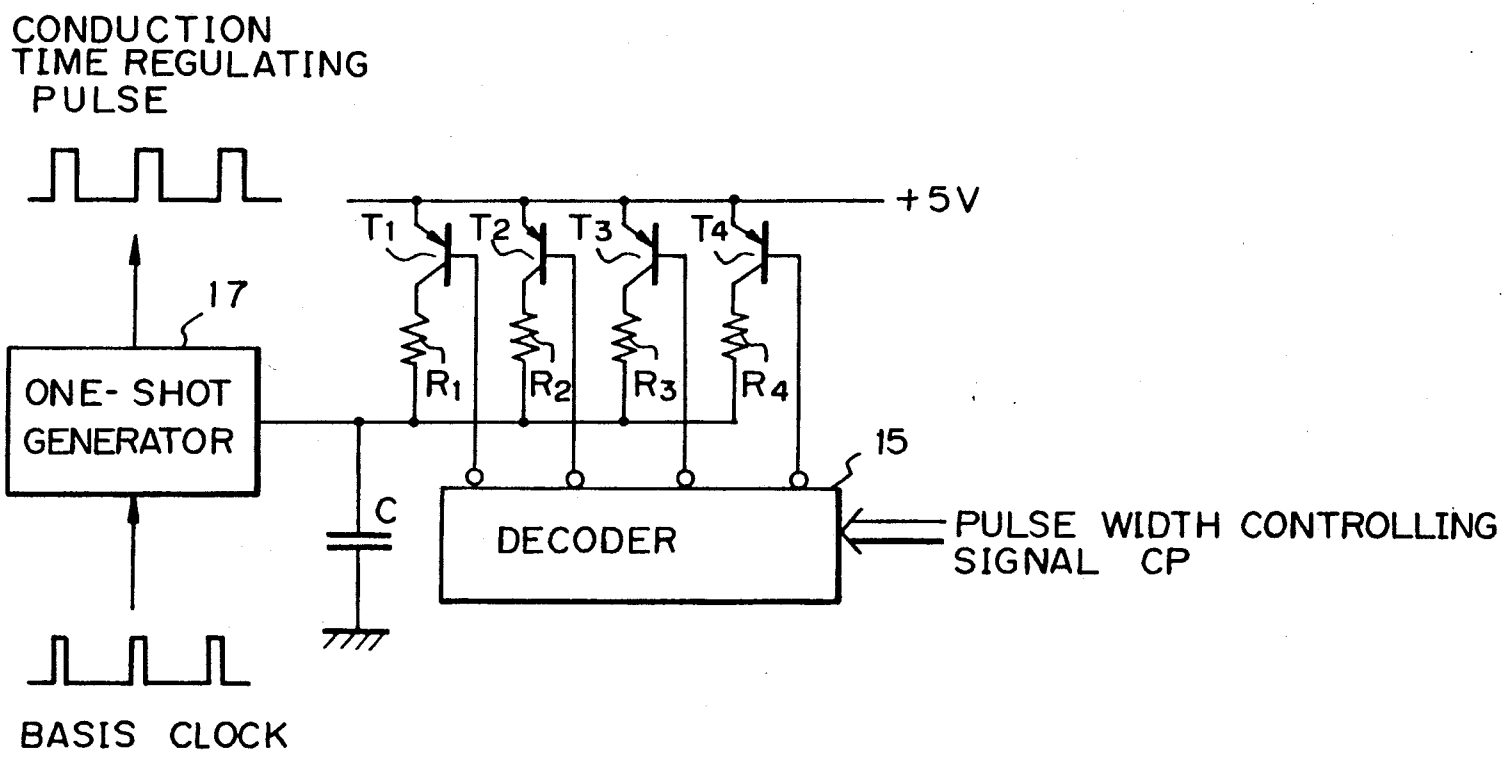
FIG. 6 is a block diagram showing one example of a pulse width controlling portion in FIG. 5.

FIG. 6 is a block diagram showing one example of the pulse width controlling portion 13 in which each of references R1–R4 shows a resistor arranged in parallel to the power source line and of different resistance value (for example, R1>R2>R3>R4), and each of references T1–T4 shows a transistor for switching arranged in series to the resistors R1–R4 to switch and select the resistors R1–R4.

A decoder 15 generates a switching signal for conducting any of the transistors T1–T4 corresponding to the power source voltage controlling signal CP of 2-bit binary which is supplied from CPU 20.

Reference numeral 17 shows one-shot generator which, upon condensing of a condensor C via the selected resistor, generates a conduction regulating pulse of the heat generating elements 3 from the basic clock, based on a time period in which both ends voltage of the condenser C reaches to a predetermined value.

In such construction, CPU 20 adjusts voltage judging the data content developed in the memory 9. In detail, CPU 20 calculates the on-data number (the number of actuating bits) included in every data of predetermined amount (for example, in every total amount of data within the predetermined time period, in every one block associated with actuation by any of the head actuating portion 7-1–7-k, or in every data corresponding to 1-line), or calculates an average thereof; accesses the voltage adjusting data of ROM 21 based on the result thus calculated; and determines the controlling signal CP of power source voltage to supply it to the power source device 5 for the head.

In this way, the controlling signal sent out from CPU 20 in 2-bit binary enters into the decoder 15, and any of transistors T1–T4 is selected to be corresponding to value thereof. If the resistors R1–R4 are switched corresponding to the above a voltage Vin of power source voltage adjusting line will vary and the power source voltage will vary corresponding to the actuating bit number.

Figure 7:
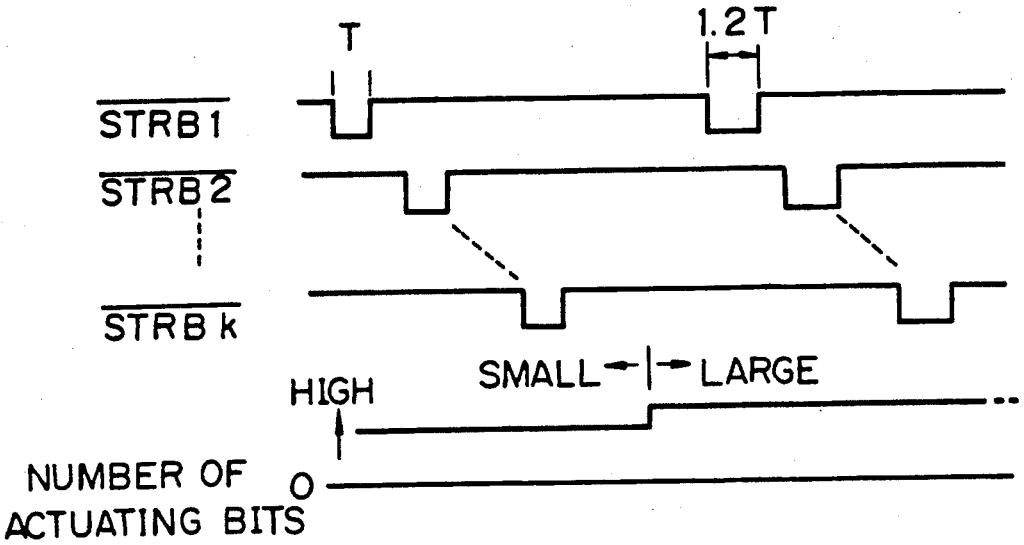
FIG. 7 is a wave configuration diagram for explaining a modified embodiment of a translating time relative to the heat generating element.

For example, in case the number of actuating bits is small, as shown in FIG. 7, since the voltage decrease due to the wire resistance is small, the resistor enabling to obtain the conduction time regulating pulse of small pulse width T (superposed to the strobe signals STRB1–STRBk) will be selected, and the resistor enabling to obtain the larger or wider pulse width as the number of actuating bits becomes larger will be selected.

By adjusting the conduction time in this way, because the variation of voltage decrease due to the wire resistor R corresponding largeness or smallness of the number of actuating bits can be canceled, it becomes possible to supply stabilized actuating energy to the heating elements 3.

Figure 8:
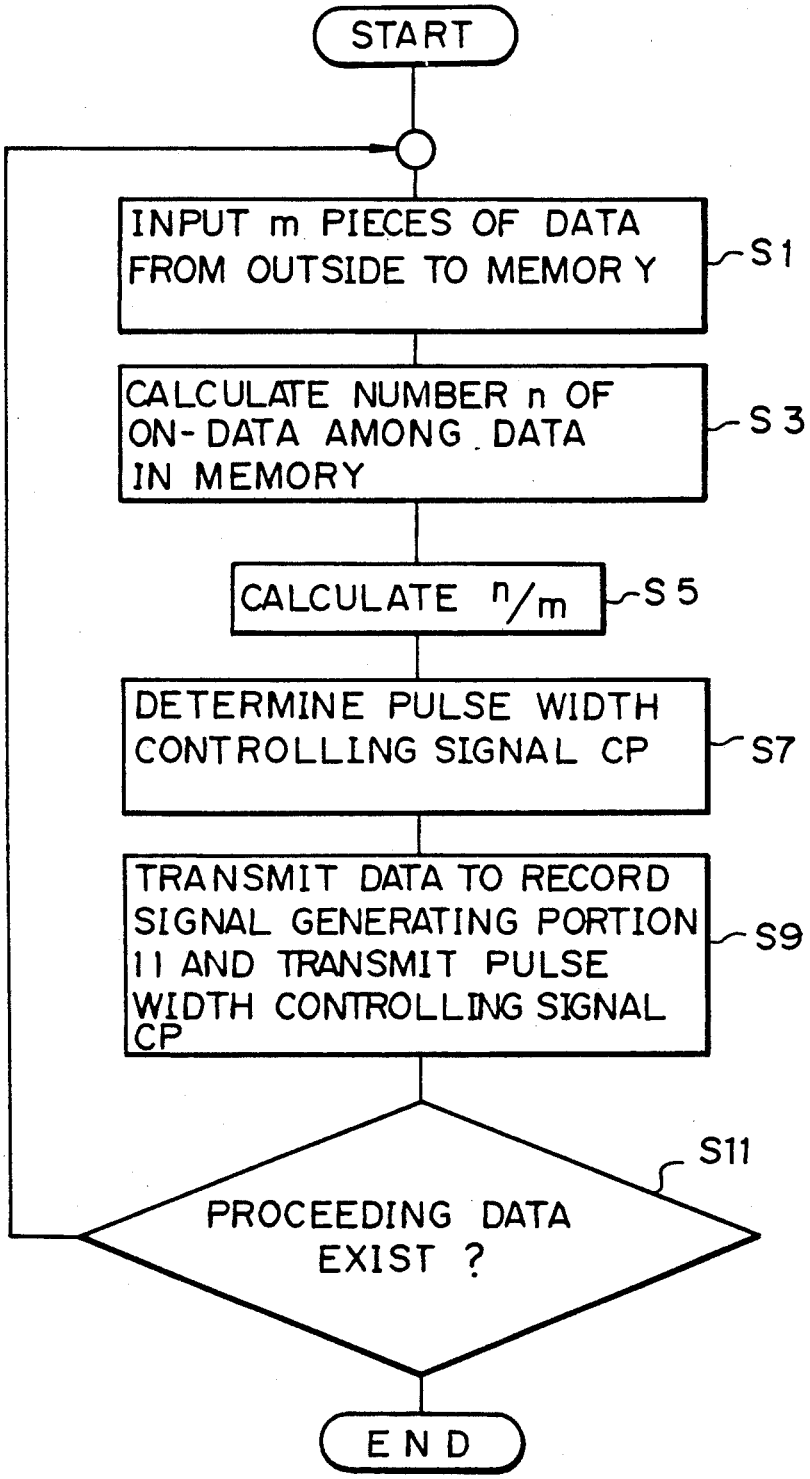
FIG. 8 is a flow chart showing one example of processing sequence of pulse width adjustment in the embodiment of FIG. 5.

FIG. 8 is a flow chart showing one embodiment of voltage adjustment processing sequence by CPU 20. In the first, when predetermined amount m (for example, amount of 1-line) of image data is inputted into the memory 9 from the host device H outside in the step S1, the number of on data of the heat generating elements 3 thereamong, i.e. the number of actuating bits n is calculated in the step S3. Then, value of n/m is calculated in the step S5, and 2-bit binary value of the power source voltage controlling signal CP is determined with reference to the data area of ROM 21, corresponding to the value calculated.

In the step S9, CPU 20 sends out the image data to the record signal generating portion 11 from the memory 9, and supplies controlling signal CP to the power source device 5. If the recording is carried out in this state by actuation of the heat generating element 3, because the stabilized voltage VH is applied to the heat generating element 3 regardless of the number of actuating bits, discharging energy to be acted to the ink will be stabilized.

Then, in the step S11, existence of the image data to be recorded next is judged, and in the case there exists such data the process returns to the step S1, while if there exists no such data the process will be finished.

In this way, according to the present embodiment, it is possible to provide stabilized discharging energy to the ink regardless of the number of actuating bits. This enables carrying out stabilized ink discharging which leads to the image recording which is stabilized and of high quality. Because the recording on data is calculated with respect to the image data developed in the image memory 9 to be switched, delay for voltage compensation relative to the number of actuating bits will not occur compared with the case in which the voltage compensating circuit is added to the power source device itself.

If the construction is made so that the number of actuating bits is calculated in a translating process of the image data IDATA to the memory 9 by a counter or the like, processing time of the above steps S1 and S3 can be shortened.

In the above embodiment, the transistors T1–T4 as well as the resistors R1–R4 are provided to adjust the voltage in four stages by the controlling signal CP of 2-bit binary, but needless to say the number of the stages and switches are freely selected.

Additionally, in the above embodiment only the conduction time of the heating elements 3 is adjusted, but in addition thereto, it is possible to adjust the supplying voltage of the power device to make actuating energy constant.

As mentioned heretofore, according to the present invention, because the stabilized actuating energy is supplied to discharge energy generating mean regardless of the number of actuating bits, the stabilized discharging energy is acted onto the ink, which enables carrying out the image recording of high quality on account of the stabilized ink discharging condition.

Figure 9:
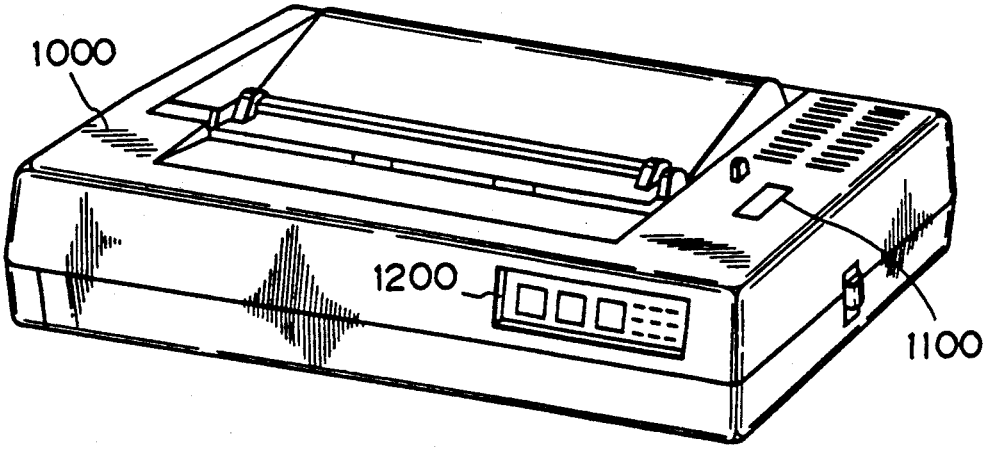
FIG. 9 is a typical perspective view showing the ink jet recording device according to the present invention.

FIG. 9 is a typical perspective view showing an ink jet device of the present invention, in which reference numeral 1000 shows a body of the device, numeral 1100 shows a power source switch, and numeral 1200 shows an operating panel.

It is noted that the device is not limited to the line printer type having the recording head 1 of so-called full line type in which the discharging openings are arranged corresponding to the width of the recording medium, but the present invention can be applied effectively and easily to the type in which plural heat generating elements are actuated by the common electrode.

Additionally, in the ink jet head used in the Present invention, the direction into which the ink is supplied to the heat generating portion of the heat generating element within the liquid path can be selected substantially said as or different from (for example, orthogonal to each other) the direction into which the ink is discharged from the discharging opening.

We claim:

1. An ink jet recording apparatus comprising:

plural energy generating means for generating energy used for discharging an ink;

detecting means for detecting the number of said energy generating means actuated at the same time;

adjusting means for adjusting a voltage value of the actuating pulse applied, corresponding to a result detected by said detecting means, to said energy generating means.

2. An ink jet recording apparatus according to claim 1, wherein said energy generating means generates thermal energy.

3. An ink jet recording apparatus according to claim 1, wherein said energy generating means is an electro-thermal converting member.

4. An ink jet recording apparatus according to claim 3, wherein said electro-thermal converting member includes a heat generation resisting member and an electrode connected thereto.

5. A ink jet recording apparatus according to claim 1, further comprising an ink jet head to which said energy generating means is provided.

6. An ink jet recording apparatus according to claim 5, wherein said ink jet head includes a liquid path in which said energy generating means is provided.

7. An ink jet recording apparatus according to claim 6, wherein said ink jet head includes an ink discharging opening communicated with said liquid path.

8. An ink jet recording apparatus according to claim 6, wherein said ink jet head includes an ink discharging opening communicated with said liquid path, a direction into which the ink is discharged from said discharging opening, and a direction into which the ink is supplied to a portion of said liquid path where said energy generating means is provided being substantially same.

9. An ink jet recording apparatus according to claim 6, wherein said ink jet head includes an ink discharging opening communicated with said liquid path, a direction into which said ink is discharged from said discharging opening, and a direction into which the ink is supplied to a portion of said liquid path where said energy generating means is provided being substantially orthogonal to each other.

10. An ink jet recording apparatus according to claim 6, wherein plural discharging openings are arranged corresponding to a width of a recording medium.

11. An ink jet recording apparatus according to claim 6, wherein said ink jet head includes a common liquid chamber communicated with said liquid path.

12. An ink jet recording apparatus according to claim 11, wherein said ink jet head includes a supplying tube communicated with said common liquid chamber.

13. An ink jet recording apparatus according to claim 12, wherein a filter is provided to said supplying tube.

14. An ink jet recording apparatus according to claim 1, wherein said adjusting means adjusts the actuating time of said actuating pulse together with a voltage value of said actuating pulse.

15. An ink jet recording apparatus comprising:

plural energy generating means for generating energy used for discharging an ink;

detecting means for detecting the number of said energy generating means actuated at the same time;

adjusting means for adjusting an actuating time of an actuating pulse applied to said energy generating means corresponding to a result detected by said detecting means.

16. An ink jet recording apparatus according to claim 15, wherein said energy generating means generates thermal energy.

17. An ink jet recording apparatus according to claim 15, wherein said energy generating means is an electro-thermal converting member.

18. An ink jet recording apparatus according to claim 17, wherein said electro-thermal converting member includes a heat generation resisting member and an electrode connected thereto.

19. An ink jet recording apparatus according to claim 15, recording apparatus an ink jet head to which said energy generating means is provided.

20. An ink jet recording apparatus according to claim 19, wherein said ink jet head includes an ink discharging opening communicated with said liquid path.

21. An ink jet recording apparatus according to claim 19, wherein said ink jet head includes a liquid path in which said energy generating means is provided.

22. An ink jet recording apparatus according to claim 21, wherein said ink jet head includes an ink discharging opening communicated with said liquid path, direction into which the ink is discharged from said discharging opening, and a direction into which the ink is supplied to a portion of liquid path where said energy generating means is provided being substantially orthogonal to each other.

23. An ink jet recording apparatus according to claim 21, wherein said ink jet head includes an ink discharging opening communicated with said liquid path, a direction into which said ink is discharged from said discharging opening, and a direction into which said ink is supplied to a portion of said liquid path where said energy generating means is provided being substantially orthogonal to each other.

24. An ink jet recording apparatus according to claim 21, wherein plural discharging openings are arranged corresponding to a width of a recording medium.

25. An ink jet recording apparatus according to claim 21, wherein said ink jet head includes a common liquid chamber communicated with said liquid path.

26. An ink jet recording apparatus according to claim 25, wherein said ink jet head includes a supplying tube communicated with said common liquid chamber.

27. An ink jet recording apparatus according to claim 26, wherein a filter is provided to said supplying time.

28. An ink jet recording apparatus comprising:

plural energy generating means for generating energy used for discharging an ink;

detecting means for detecting the number of said energy generating means actuated at the same time;

selecting means for selecting a voltage value of the actuating pulse applied to said energy generating means, the voltage value corresponding to the number of actuated energy generating means detected by said detecting means.

29. An ink jet recording apparatus comprising:

plural energy generating means for generating energy used for discharging an ink;

detecting means for detecting the number of said energy generating means actuated at the same time;

selecting means for selecting an actuating time of an actuating pulse applied to said energy generating means, the actuating time corresponding to the number of actuated energy generating means detected by said detecting means.

* * * * *